United States Patent [19]

Healey

[11] 4,019,748

[45] Apr. 26, 1977

[54] METHOD OF PLAYING A GOLF GAME

[76] Inventor: Gerald P. Healey, 1265 Wednesbury Circle, Akron, Ohio 44313

[22] Filed: Mar. 24, 1975

[21] Appl. No.: 561,280

Related U.S. Application Data

[63] Continuation-in-part of Ser. No. 451,455, March 15, 1974, abandoned.

[52] U.S. Cl. ..... 273/176 AB; 273/176 A

[51] Int. Cl.[2] ..... A63B 69/36

[58] Field of Search .... 273/176 A, 176 AB, 176 R, 273/176 AA, 176 B, 176 E, 176 G, 176 L

[56] References Cited

UNITED STATES PATENTS

| | | | |
|---|---|---|---|
| 1,851,423 | 3/1932 | Ely | 273/176 A |
| 2,003,074 | 5/1935 | Gage | 273/176 A |
| 2,455,806 | 12/1948 | Reach | 273/176 A |
| 2,490,961 | 12/1949 | Hendry | 273/176 A |
| 2,846,229 | 8/1958 | Morris | 273/176 AB |
| 3,129,943 | 4/1964 | McKee | 273/176 A |
| 3,578,333 | 5/1971 | Elesh | 273/176 R |
| 3,671,042 | 6/1972 | Garber | 273/176 AB |
| 3,695,619 | 10/1972 | Brobston | 273/176 A |
| 3,784,207 | 1/1974 | Gentiluomo | 273/176 A |
| 3,826,501 | 7/1974 | Hiromachi | 273/176 A |

*Primary Examiner*—George J. Marlo
*Attorney, Agent, or Firm*—Reese Taylor

[57] ABSTRACT

A compact golf course is disclosed which enables the game of golf to be played in an area which comprises approximately ten percent of the conventional area required for a golf course, while still permitting a test of all skills necessary to play the game of golf. The golf course layout basically includes three "holes," the first of which is intended primarily as a test of the woods and long irons and has a plurality of teeing areas at one end and graded target areas at the opposed end. The hole is bounded by rough areas, and five balls are hit from preselected tee areas to the target area. The second "hole" is parallel to the first and is intended as a test of the middle and long irons and also has a plurality of tee areas and a graded target area, with five balls again being hit from preselected tees to the target area. The third "hole" actually consists of two identical "holes" arranged in end-to-end relationship with the second hole and, again, parallel to the first and is intended to be a test of the short irons, approach shots, and putting, with again balls being hit from five preselected basis of their landing location. Balls are then putted out, and points are awarded based upon the distance of putts. The approximate length of the second and third holes equals that of the first so that the overall course layout is highly compact, while permitting all of the various strokes normally employed in a golf game to be utilized.

3 Claims, 5 Drawing Figures

METHOD OF PLAYING A GOLF GAME

RELATED APPLICATIONS

This application is a continuation-in-part of Applicant's earlier filed application Ser. No. 451,455 filed March 15, 1974, now abandoned.

BACKGROUND OF THE INVENTION

This invention, in general, relates to the game of golf and, in particular, to a compact golf course design and a method of playing a game on such a course which permits, as nearly as possible, the actual game of golf to be simulated, in that virtually all of the clubs normally employed in playing a round of golf will be utilized. All of this is intended to be accomplished in a very small area, especially when compared to the area of a normal golf course.

SUMMARY OF THE INVENTION

The popularity of the game of golf needs no explanation, but suffice it to say that as golf has grown in popularity, certain definite problems have arisen and will continue to arise for the foreseeable future.

The first of these problems relates primarily to the ratio of available golf courses to the number of players who desire to play the game, with the result being that the total length of time required to play a game of golf has increased considerably.

The second problem is primarily one of space. Specifically, in and around most urban areas, which is where the majority of golfers would be found, land has become and will continue to be at a premium, and therefore the normal 130 to 150 acres required for a golf course becomes increasingly difficult to justify on the basis of cost.

As the above-noted prior art illustrates, there have been numerous attempts to solve these problems by a variety of means, all of which generally involve miniaturizing the game in some respect. As pointed out above, however, none of these attempts has proved entirely satisfactory since nearly all of them result in a considerable sacrifice of realism and thoroughness with regard to the number of clubs used, etc., in order to achieve the economy of space desired.

The present invention is intended to alleviate the problems noted above by providing a golf course design which occupies a minimal amount of space (about twelve acres in the form of the invention illustrated), but which will enable the game to be played quite rapidly, especially when compared with the time spent on a normal golf course, without sacrificing the realism of the game in hardly any way.

It has been found that if three holes are provided, one of which is intended and designed primarily for the woods and long irons and is provided with a plurality of teeing areas and a graded target area, that five shots can be hit, either all from the same distance or from a plurality of distances, to the target area, with points being awarded depending upon the landing point of the ball. No putting is necessary on this hole, and accordingly the time required to play the first hole is the time required for the player or players to hit the five balls and record his score. Following this, of course, the next group would take their places.

The second hole runs parallel to the first and, again, has a plurality of teeing areas and a graded target area and is intended for the middle and long irons. Again, five shots can be hit from predetermined teeing areas, and all that is required by way of time is the time necessary to hit the five shots, record the scores, and move to the third hole.

The third hole is also parallel to the first hole and extends longitudinally of the second hole. This hole is intended to test the short irons, approach shots, and putting and is divided in reality into two holes, with the thought being that since there will be actual putting taking place on this hole, it will take more time to play the hole than to play holes one and two. Again, five shots are hit in varying locations to the green and are scored depending upon their landing position on the green. The balls are then putted out and points are awarded depending upon the distance of the individual putts.

Accordingly, by this method of golf course design and by this method of playing the game it is possible to both reduce the acreage required for the course while speeding up the tempo of play, and without sacrificing the variety of shots which would be encountered in an actual golf course.

By way of example with regard to the space limitations, it is contemplated that the present course could be constructed in an area approximately 500 feet wide and 1000 feet long, or on approximately twelve acres of land. This is in contrast to a conventional golf course which would require 130 to 150 acres.

Accordingly, production of an improved golf course and a method of playing the same becomes the principal object of this invention, with other objects thereof becoming more apparent upon a reading of the following brief specification, considered and interpreted in view of the accompanying drawings.

Of the Drawings

DESCRIPTION OF THE PREFERRED EMBODIMENT

A. THE GOLF COURSE LAYOUT

Figure 2:
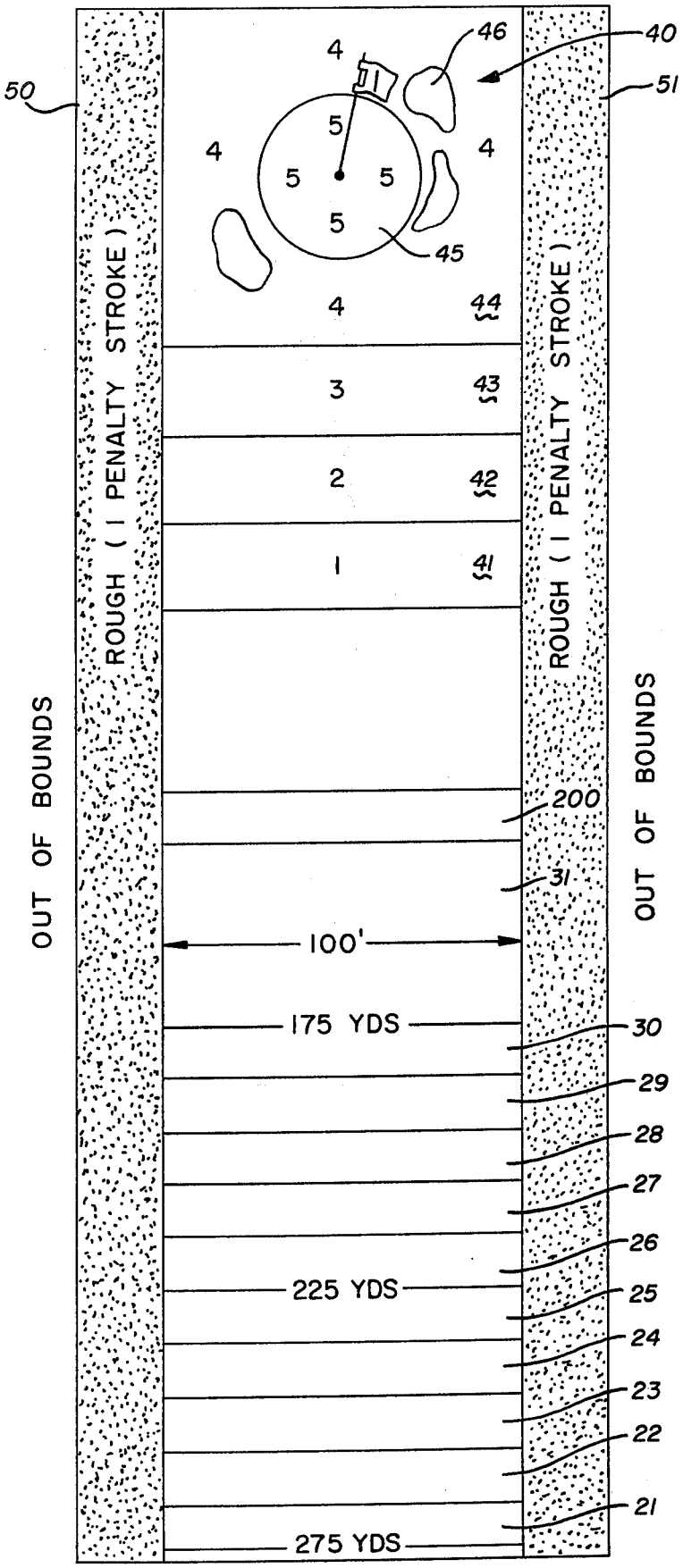
FIG. 2 is a plan view in detail of the first hole.

Before describing the layout of the golf course, it should first be noted that when the term "hole" is utilized herein, it is intended to encompass the overall area from tee to green including the fairway, etc., such as shown, for example, in FIG. 2. Furthermore, the term "graded" when utilized herein is intended to relate to a numerical grading for scoring purposes and not to a topographical grading or contouring.

Figure 1:
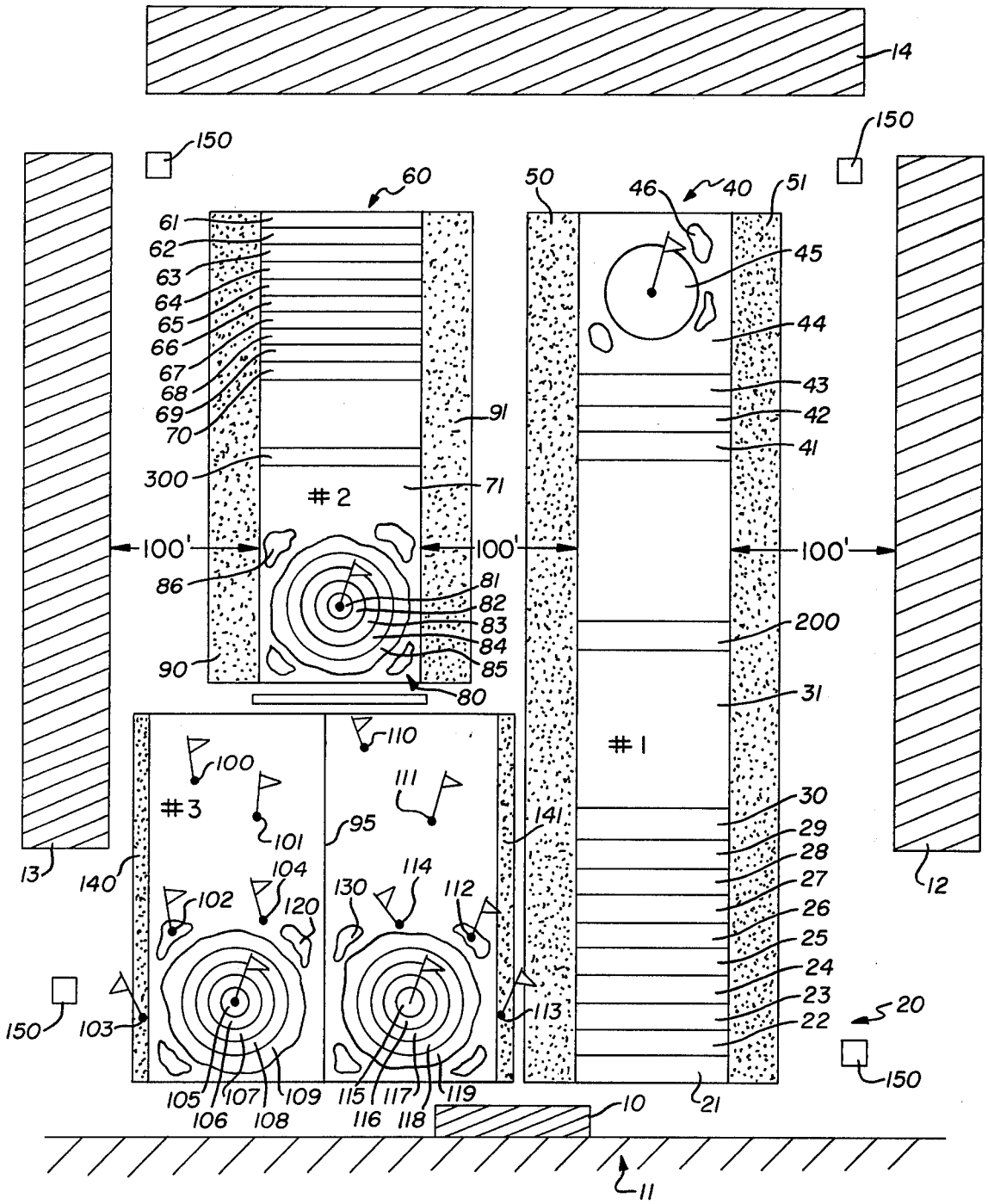
FIG. 1 is a plan view of the overall golf course.

Considering first then FIG. 1, the overall layout of the golf course is illustrated therein. Hole No. 1, it will be noted, is approximately 300 yards long, as illustrated, with Hole No. 2 running parallel to it in side-by-side relationship and extending approximately 200 yards. Hole No. 3 again is parallel to Hole No. 1 and in end-to-end relationship to Hole No. 2 and extends approximately 100 yards so that, as illustrated, the overall length of the golf course itself is approximately 300 yards and its width approximately 200 yards.

It should be noted at this point that these dimensions are approximate only and could be varied depending upon the building site, and they are cited as examples only of the space-saving economy which can be achieved with this type layout.

In the plan view of FIG. 1 certain ancillary structures are also illustrated schematically, such as a clubhouse 10, a parking area 11, and bleachers 12, 13, and 14 surrounding the perimeter of the course. In this regard, the schematic showing of the bleachers 12, 13, and 14 could be replaced by condominiums or apartment buildings or townhouses, as may be desired and as will be described later in greater detail. Also lighting, schematically shown at 150, can also be provided.

Referring then to FIGS. 1 and 2 for a detailed description of the Hole No. 1, it will be noted that this hole has a teeing area 20 which consists of a plurality of individual tees 21, 22, 23, 24, 25, 26, 27, 28, 29, and 30. The maximum distance illustrated is 275 yards for area 21, and the minimum is 175 yards for the area 30. The intermediate distances are graduated in suggested increments of 10 yards, and the purpose of the plurality of teeing areas will be described in the description of the actual playing of the game.

Immediately adjacent the teeing area 20 is a fairway area 31 which leads to a target area 40. Target area 40 has a green 45 and is suitably trapped by sandtraps 46, 46. The target area is divided into five landing areas 41, 42, 43, 44, and the green itself 45. Various points can be awarded depending upon the landing area in which the ball comes to rest, and this also will be described in greater detail with regard to the method of playing the game. The No. 1 Hole is bounded on both sides by rough 50 and 51 and, of course, has out-of-bounds on the outer limits of the rough areas.

Figure 3:
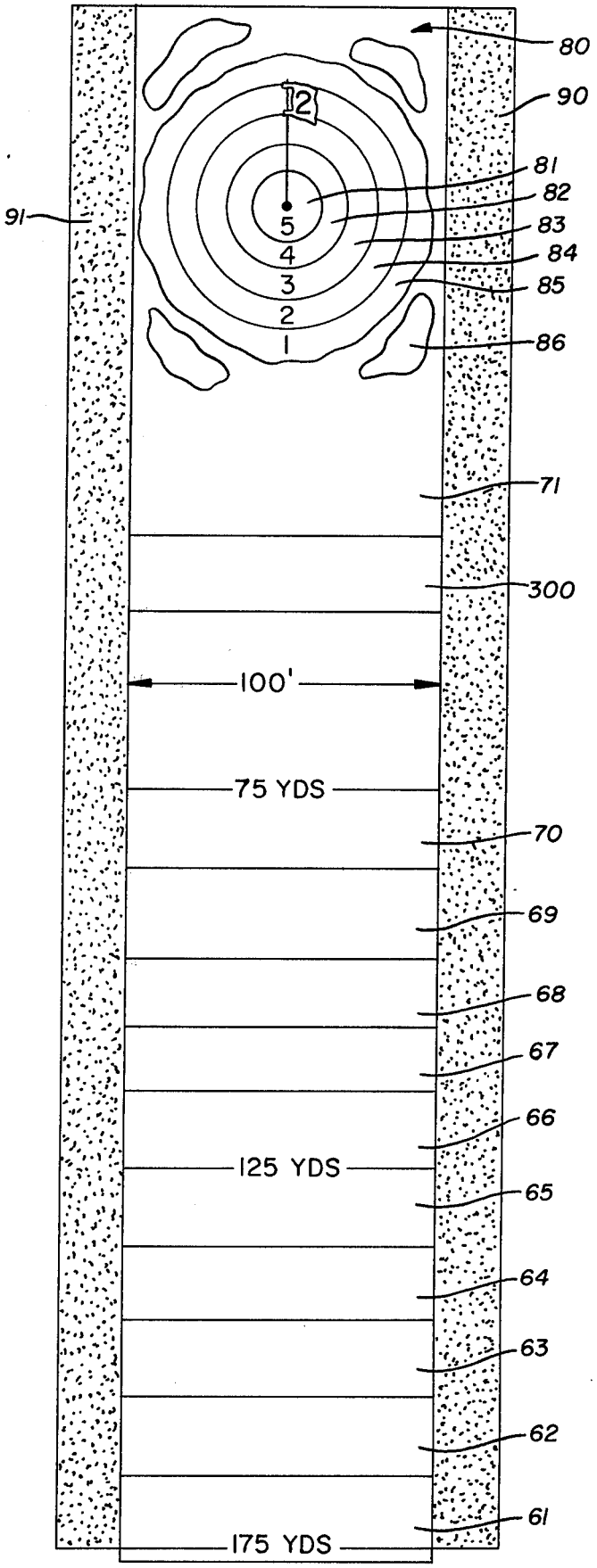
FIG. 3 is a plan view in detail of the second hole.

Considering FIGS. 1 and 3 next then for an examination of Hole No. 2, it will be noted that this hole also has a plurality of teeing areas 61, 62, 63, 64, 65, 66, 67, 68, 69, and 70, generally indicated by the numeral 60 and ranging from 175 yards to 75 yards from the green in ten-yard increments. Immediately contiguous to the teeing area 60 is a fairway area 71 and a target area 80. The target area 80 is suitably trapped as at 86, 86 and is marked with a series of concentric circles 81, 82, 83, 84, and 85, and again it is contemplated that points will be awarded depending upon the actual landing area of the ball. The second hole is also surrounded by rough 90 and 91, and again the out-of-bounds lines would be the perimeter of the rough areas.

Figure 4:
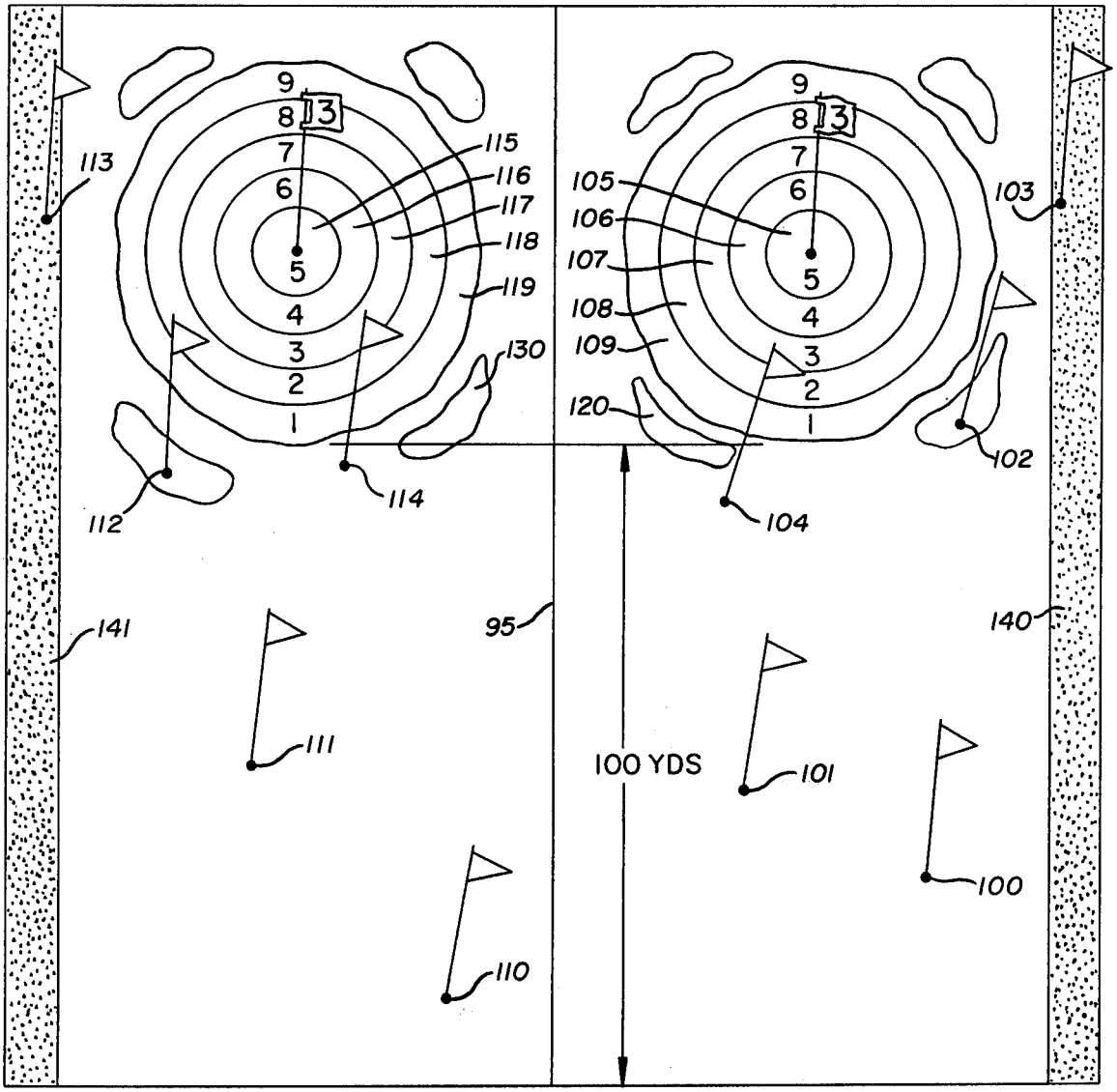
FIG. 4 is a plan view of the third hole.

Hole No. 3 shown in FIGS. 1 and 4 is in reality two holes. The purpose of this, as explained above, is that it is felt that this hole will take longer to play due to the fact that putting is involved, and therefore by providing two parallel holes which are identical, it is felt that a greater number of players can be accommodated.

Hole No. 3 consists of a fairway area which has a plurality of teeing points. These points are identified by numerals 100 to 104 and 110 to 114. A target area is provided and is marked in concentric circles from 105 through 109 in one instance and from 115 through 119 in another instance. Suitable traps 102 and 130 are provided, and rough areas 140 and 141 are also provided on these holes. A safety restraining screen 95 is optionally provided down the center of the third hole for safety purposes.

B. THE METHOD OF PLAY

Having thus described the overall layout of the course, attention is now directed to the method of playing the course.

Accordingly and considering FIGS. 1 and 2, attention is directed to Hole No. 1. On this hole, which is considered to be a test of the woods and long irons, a plurality of teeing areas 21 through 30 are provided. The players may all hit from the same teeing areas or, if they desire to handicap one player over another, they may hit from different teeing areas. In any event, five tee shots are hit from one or more of the areas 21 through 30. The landing point in the landing area 40 is, as clearly shown in the drawings, graded or marked, and points are awarded depending upon the specific portion of the landing area 40 in which the ball falls. Specifically, for example, a ball hit into the green 45 receive five points, while a ball hit into the area 44 receives four points; the area 43, three points; the area 42, two points; and the area 41, one point. After each player has hit his five balls, his score may be readily tabulated, with it being noted that a maximum of 25 points may be achieved on this hole as illustrated.

It should also be noted that a ball landing in the rough areas 50 and 51 receives one penalty point, and that would be subtracted from the overall score. To further simulate realism, every swing counts. Thus a complete miss or "whiff" also results in a penalty, with this rule applying to all three holes. Furthermore, a ball hit out-of-bounds or short of area 41 would receive a zero score.

Once the players have completed hitting their shots and tabulating their scores on Hole No. 1, they will proceed to the teeing area 60 of Hole No. 2. At this time the next group of players will be able to repeat the same process on the first hole.

The second hole is intended to be a test of the middle and long irons and, as shown in FIGS. 1 and 3, has a plurality of teeing areas indicated by the numerals 61 through 70 which are disposed various distances from the target area. The selection of which teeing areas to hit from is, again, optional with the players and subject to pre-arrangement. On this second hole, the landing area 80 consists of a green which has graded concentric circles 81, 82, 83, 84, and 85 marked thereon. Again five balls are hit from the appropriate teeing areas, and points are awarded on the basis of five points for landing in area 81; four points for area 82; three points for area 83; two points for area 84; and one point for area 85. In this fashion, again a total of 25 points is possible on this particular hole. A ball that does not land on the green receives no points, and again no putting takes place. Once the players have completed the second hole and tabulated their scores, they will move to one of the two areas in Hole No. 3, following which, of course, the next group may take over the second hole and commence play.

On Hole No. 1 and Hole No. 2 it is also contemplated that in order to further speed up play, fore caddies or ball boys would be utilized to mark the landing area, and in this fashion the participants, will not have to recover or retrieve their balls but will simply be able to mark their scores based upon flags or other suitable indicia displayed by the fore caddies.

Hole No. 3, as noted earlier, is really divided into two holes and is intended as a test of the short irons, approaches, and putting. Each player will hit five balls from one of each of the hitting areas which are designated as 100, 101, 102, 103, and 104 and 110, 111, 112, 113, and 114.

The greens are again divided into concentric circles 105, 106, 107, 108, and 109 and 115, 116, 117, 118, and 119. Points are awarded on the balls which are hit into the green on the basis of the landing area. Therefore, a ball landing in the areas 105 or 115 would receive five points. The areas 106, 116 would receive four points; and 107, 117, three points; 108, 118, two points; and 109, 119, one point. After all of the players have hit their balls to the green, they then proceed to the green for putting. Each ball for each player is putted from the spot at which it came to rest on the green. Accordingly, the points are awarded in reverse order for the putting to that which was described with regard to the approach shots.

Specifically, assuming one had landed in area 105 or 115 and obtained a maximum of five oints for his approach shot, a putt from that distance would be worth five points. On the other hand, had he landed in area 106 or 116, he would have received four points for his approach shot; and if he makes the putt from that area, he would receive six points for his put for a total of ten points. In this way it is possible to equalize matters between the player who is a poorer approach shot artist but a better putter. Again, this simulates the game of golf in that if a player can "get down in" two from off the green, he should be, and would be in a regular game of golf, charged with two strokes regardless of whether he made an extraordinary approach and an easy putt or vice versa.

Of course, on this hole it is possible to accumulate 50 points maximum, with the overall game making it possible to score a perfect score of 100.

It should be noted that, as illustrated in FIGS. 1 through 4, the better shot is rewarded with the higher point total. However, in order to more accurately simulate the actual game of golf, these values may be reversed so that the better the shot, i.e., the nearer the pin the shot lands, the lower the points awarded so that the total low scorer would be the winner.

It should also be noted that in addition to the features described herein, it would also be possible to provide lighting so that the course could be utilized at night.

Additionally, as noted earlier, the schematic illustrations indicated by the numerals 12, 13, and 14 can represent apartments, condominiums, etc., which would be built around the periphery of the course or, if desired, bleachers could be erected. In view of the rather minimal distances involved in this design, spectators seated in the approximate positions of the units indicated at 12, 13, and 14 could readily view the entire course. This design, therefore, lends itself to a degree of spectator attraction and convenience, which is not really possible in a conventional golf course. The difficulties of distance, etc., in a conventional golf course make it extremely difficult for a spectator to obtain an overall appreciation of the contest as it progresses. That difficulty is either minimized or eliminated with this particular design and method of playing the game.

C. THE MODIFICATION OF FIG. 5

Figure 5:
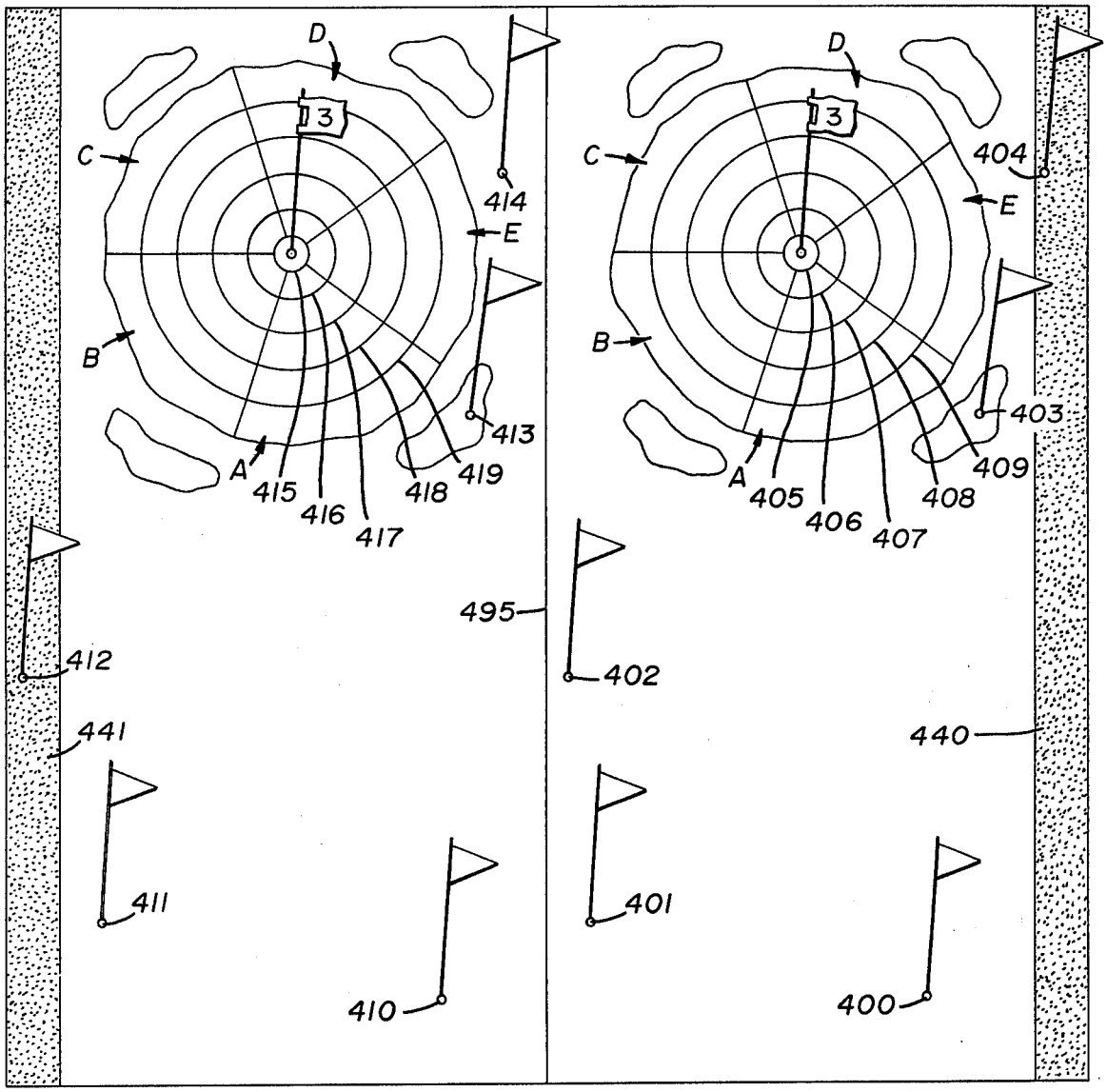
FIG. 5 is a plan view of a modified layout for the third hole.

FIG. 5 also illustrates a form of the third hole in which two side-by-side layouts are presented similar to that shown in FIG. 4. A plurality of teeing areas 400 through 404 and 410 through 414 are provided which will enable the player to hit five shots from the designated areas to the green, with points being awarded depending upon the landing area represented by the concentric circles marked thereon. In this regard, of course, the closer to the pin, the better the score for the approach shot.

The modified form of Hole No. 3 also permits putting, as does the form shown in FIG. 4. Putting, however, on the modified version is somewhat different.

It will be noted that each of the greens is divided into segments identified as A through E, and it is contemplated that each player would hit five putts of increasing length, one from each of the segments A through E. In this regard the putter with honors would choose the first area such as, for example, segment A and would place his ball or, alternatively, have his opponent place his ball somewhere on the line 405 or 415. The balls of the remaining players would be similarly placed in the remaining segments depending on the number of players, but all being placed on the 405 or 415 line.

After the players have putted out from that distance, they will all rotate clockwise to the next adjacent segment. In this instance the first player would move to segment B, and the ball would be placed on the line 406 or 416, with the other players similarly rotating to the next adjacent segment and having their balls placed on the same line representing the same distance from the pin. Once they have all putted out from that distance, they will move to the next segment, and of course in this instance the first player would move to segment C and place his ball on the line 407 or 417, as the case may be. A total of five putts will be employed, with scoring being awarded similarly to that described in connection with the form of the invention shown in FIGS. 1 through 4.

Accordingly, it will be noted that both forms of the invention disclosed herein comprise an extremely compact golf course and has really relatively very minimal acreage requirements. As an additional consequence, the particular layout of the holes permits the game to be played very rapidly compared to the several hours time required to play a conventional golf course.

On the other hand, and notwithstanding the compactness of the course, it is possible for the golfer to employ virtually every club that he would ever normally utilize on a conventional golf course, and every type and distance of shot. Accordingly, the desired savings of space and thereby money are achieved without sacrificing the realism factor.

It should also be noted that by providing the plurality of tee areas on Hole No. 1 and Hole No. 2, it is possible also to work out a handicap system in that an extremely long driver, for example, could be forced to tee from the areas 21, 22 for example, while a less gifted golfer would be permitted to hit his balls from areas 27 and 28 for example. This equalizes individual abilities and can be employed for that purpose if desired.

Along these same lines it will be noted that intermediate or beginners' tees are provided on Holes No. 1 and No. 2. While the holes are essentially designed to utilize the class of clubs referred to herein, the game is also intended to encourage family participation. Therefore, intermediate tees 200 on Hole No. 1 and 300 on Hole No. 2 are provided to assist children or others who otherwise would be unable to reach the target areas.

Similarly with regard to the third hole, it is contemplated that beginners or children or others may not be able to reach the green from areas on the fairway such as 400 or 410, and accordingly it is also contemplated that these parties could be permitted to hit all five balls from a point closer to the green such as, for example, 402 or 412 or 404 or 414, thereby virtually insuring that they will at least reach the green with their approach shots.

It should also be noted that certain dimensions have been set forth in the drawings and in the description, and while these approximate relative dimensions are to a certain degree important to simulate accurately the game of golf in a compact setting, they are not intended to be absolute and could be, if desired, modified depending upon the space available and the desires of the individual golf course builder or owner.

While a full and complete description of the invention has been set forth in accordance with the dictates of the Patent Statutes, it should be understood that modifications can be resorted to without departing from the spirit hereof or the scope of the appended claims.

What is claimed is:

1. A method of playing a game of golf on a three-hole golf course in which the second and third holes are disposed parallel to the first, each hole having a plurality of teeing areas and graded target areas separated by a fairway area, comprising the steps of;

A. successively hitting five balls from the teeing areas on the first hole and being apprised of the points awarded based upon the particular graded target area reached by each ball;

B. moving to the teeing areas of the second hole;

C. successively hitting five balls from the teeing areas on the second hole and being apprised of the points awarded based upon the particular graded target area reached by each ball; and D. moving to the teeing areas of the third hole;

E. successively hitting five balls from the teeing areas on the third hole and being apprised of the points awarded based upon the particular graded target areas reached by each ball, and putting five balls and being apprised of the points awarded based upon the graded target area from which they are putted.

2. The method of claim 1 further characterized by the step of being apprised of penalty strokes awarded in accordance with the rules of the game of golf.

3. A method of playing a game of golf on a three-hole golf course in which the second and third holes are disposed parallel to the first and have a combined length approximately the length of the first, each hole having a plurality of teeing areas and graded target areas separated by a fairway area, the third hole being divided into radially extending segments comprising the steps of;

A. successively hitting five balls from the teeing areas on the first hole and being apprised of the points awarded based upon the particular graded target area reached by each ball;

B. moving to the teeing areas of the second hole;

C. successively hitting five balls from the teeing areas on the second hole and being apprised of the points awarded based upon the particular graded target area reached by each ball;

D. moving to the teeing areas of the third hole;

E. successively hitting five balls from the teeing areas on the third hole and being apprised of the points awarded based upon the target area reached by each ball; and F. putting five balls from varying distances and varying segments and being apprised of the points awarded based upon the distances involved.

* * * * *